US011776522B2

(12) United States Patent
Su et al.

(10) Patent No.: US 11,776,522 B2
(45) **Date of Patent: *Oct. 3, 2023**

(54) SOUND ISOLATING WALL ASSEMBLY HAVING AT LEAST ONE ACOUSTIC SCATTERER

(71) Applicants: Toyota Motor Engineering & Manufacturing North America, Inc., Plano, TX (US); Toyota Jidosha Kabushiki Kaisha, Toyota (JP)

(72) Inventors: Xiaoshi Su, Ann Arbor, MI (US); Debasish Banerjee, Ann Arbor, MI (US); Yuji Shintaku, Toyota (JP); Katsuhiko Nakajima, Nisshin (JP)

(73) Assignees: Toyota Motor Engineering & Manufacturing North America, Inc., Plano, TX (US); Toyota Jidosha Kabushiki Kaisha, Toyota (JP)

( * ) Notice: Subject to any disclaimer, the term of this patent is extended or adjusted under 35 U.S.C. 154(b) by 282 days.

This patent is subject to a terminal disclaimer.

(21) Appl. No.: 17/172,582

(22) Filed: Feb. 10, 2021

(65) Prior Publication Data

US 2022/0148554 A1 May 12, 2022

Related U.S. Application Data

(60) Provisional application No. 63/112,948, filed on Nov. 12, 2020.

(51) Int. Cl.

| | |
|---|---|
| ***G10K 11/172*** | (2006.01) |
| ***E04B 1/84*** | (2006.01) |
| ***G10K 11/162*** | (2006.01) |

(52) U.S. Cl.
CPC ..... *G10K 11/172* (2013.01); *E04B 1/84* (2013.01); *G10K 11/162* (2013.01)

(58) Field of Classification Search
CPC ..... G10K 11/172; G10K 11/162; E04B 1/84; E04B 1/8409; E04B 2001/8414;
(Continued)

(56) References Cited

U.S. PATENT DOCUMENTS

| | | | |
|---|---|---|---|
| 2,779,429 | A | 1/1957 | Mazer |
| 3,667,175 | A | 6/1972 | Bjorksten |

(Continued)

FOREIGN PATENT DOCUMENTS

| | | | |
|---|---|---|---|
| SU | 863791 | A1 | 9/1981 |
| WO | 2020036040 | A1 | 2/2020 |

OTHER PUBLICATIONS

Extended European Search Report for European Application No. 21207952.9-1002, dated Mar. 18, 2022 (53 pages).

(Continued)

*Primary Examiner* — Jeremy A Luks
(74) *Attorney, Agent, or Firm* — Christopher G. Darrow; DARROW MUSTAFA PC

(57) ABSTRACT

A sound isolating wall assembly includes a plurality of walls defining a space between the plurality of walls. At least one acoustic scatterer is disposed within the space between the plurality of walls. The at least one acoustic scatterer has an opening and at least one channel. The at least one channel has a channel open end and a channel terminal end, with the channel open end being in fluid communication with the opening.

19 Claims, 7 Drawing Sheets

(58) Field of Classification Search
CPC ..... E04B 2001/8428; E04B 2001/8433; E04B 2001/8438; E04B 2001/8476; E04B 2001/848; E04B 2001/8485; E04B 2001/849
See application file for complete search history.

(56) References Cited

U.S. PATENT DOCUMENTS

| | | | | |
|---|---|---|---|---|
| 4,095,669 | A * | 6/1978 | Bond, Sr. | E01F 8/0052 181/210 |
| 6,892,856 | B2 * | 5/2005 | Takahashi | G10K 11/172 181/284 |
| 7,520,370 | B2 * | 4/2009 | Gudim | E04B 1/8209 181/290 |
| 7,799,410 | B2 | 9/2010 | Tinianov | |
| 8,157,052 | B2 * | 4/2012 | Fujimori | G10K 11/175 181/295 |
| 8,714,303 | B2 * | 5/2014 | Honji | G10K 11/175 181/284 |
| 8,857,563 | B1 | 10/2014 | Chang et al. | |
| 8,925,678 | B2 * | 1/2015 | Tizzoni | E01F 8/007 181/284 |
| 9,076,429 | B2 | 7/2015 | Islam et al. | |
| 9,607,600 | B2 * | 3/2017 | Swallowe | G10K 11/172 |
| 9,765,516 | B2 * | 9/2017 | Van Dinther | E04B 1/8209 |
| 10,255,900 | B2 * | 4/2019 | DeGrandis | G10K 11/20 |
| 10,714,070 | B1 * | 7/2020 | Su | G10K 11/175 |
| 11,043,199 | B2 * | 6/2021 | Lee | G10K 11/172 |
| 11,545,128 | B2 * | 1/2023 | Su | G10K 11/162 |
| 11,555,280 | B2 * | 1/2023 | Su | E01F 8/0047 |
| 11,557,271 | B2 * | 1/2023 | Su | G10K 11/162 |
| 2003/0006092 | A1 | 1/2003 | D'Antonio et al. | |
| 2017/0263235 | A1 * | 9/2017 | Elford | G10K 11/172 |
| 2018/0114517 | A1 * | 4/2018 | Yamazoe | E04B 1/994 |
| 2019/0206380 | A1 * | 7/2019 | Hakuta | G10K 11/162 |
| 2020/0103139 | A1 | 4/2020 | Schiller et al. | |
| 2020/0191432 | A1 | 6/2020 | Bauch et al. | |
| 2020/0224810 | A1 * | 7/2020 | Hakuta | F24F 13/02 |
| 2020/0284174 | A1 * | 9/2020 | Lee | F01N 1/023 |
| 2021/0010977 | A1 * | 1/2021 | Lee | G01N 21/1702 |

OTHER PUBLICATIONS

Long et al., "Multiband quasi-perfect low-frequency sound absorber based on double-channel Mie resonator," Appl. Phys. Lett. 112, 033507, 6 pages (2018).

Lee et al., "Ultrasparse Acoustic Absorbers Enabling Fluid Flow and Visible-Light Controls," Physical Review Applied, 11(2), 024022, 13 pages (2019).

Schwan et al., "Sound absorption and reflection from a resonant metasurface: Homogenisation model with experimental validation," Wave Motion 72 (2017) 154-172.

Cheng et al., "Ultra-sparse metasurface for high reflection of low frequency sound based on artificial Mie resonances," Nat. Mater. 14, 8 pages (2015).

Long et al., "Multiband quasi-perfect low-frequency sound absorber based on double channel Mie resonator," Appl Phys. Lett. 112, 033507, 7 pages (2018).

* cited by examiner

FIG. 6A
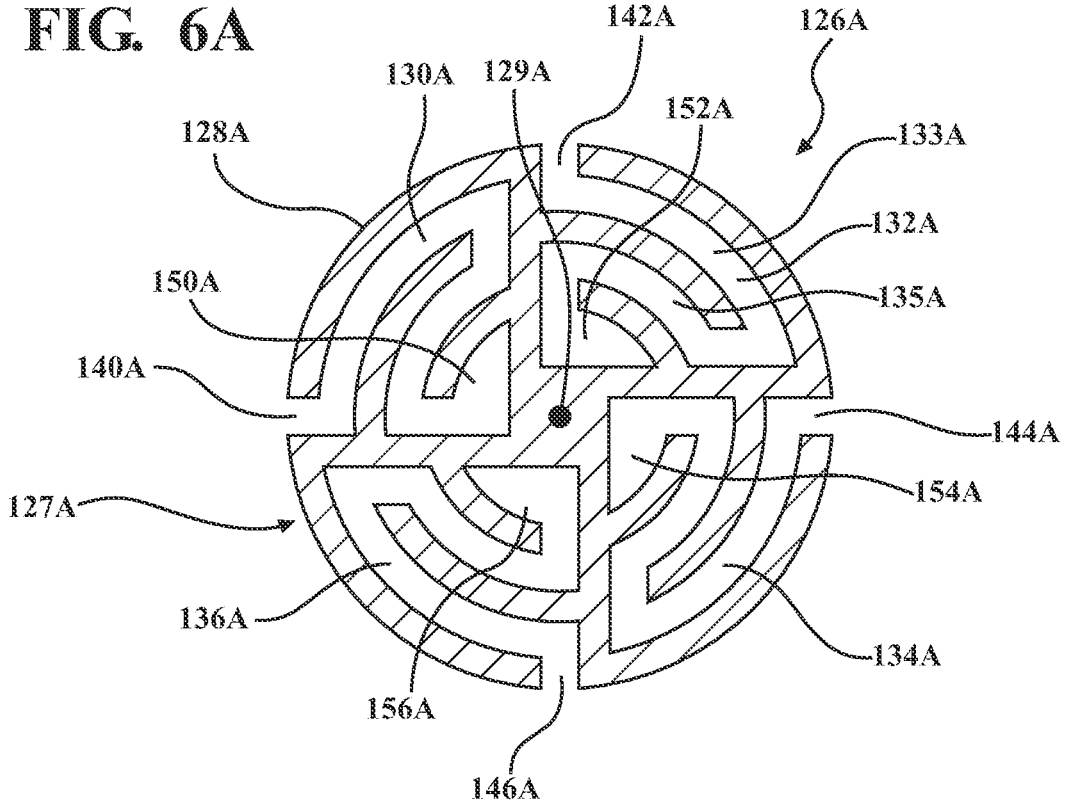
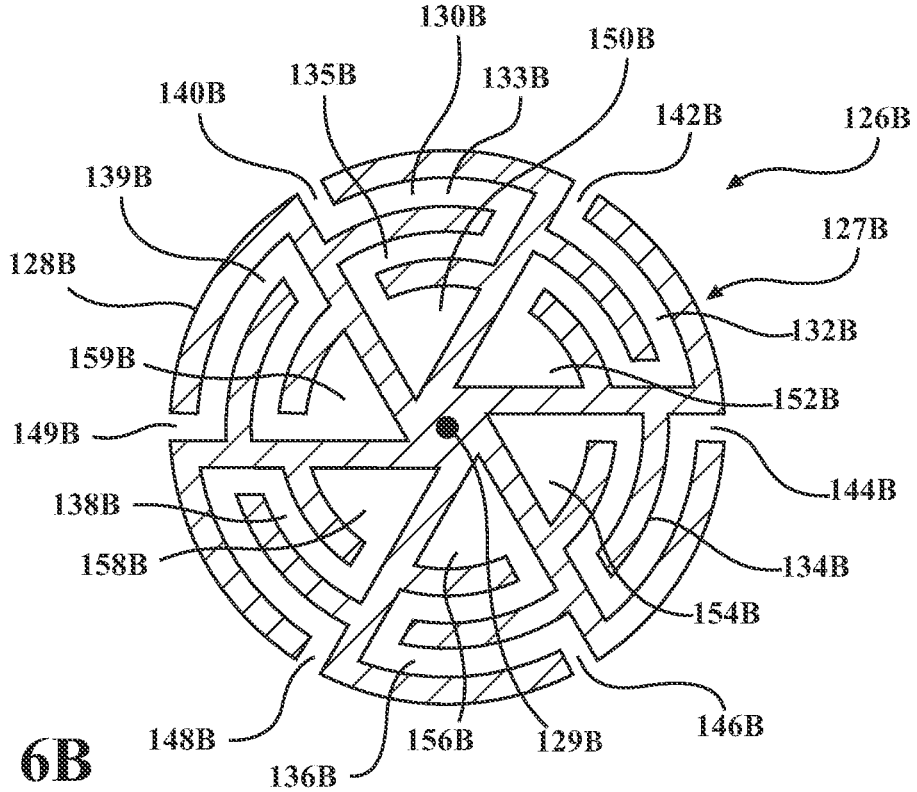
FIG. 6B

SOUND ISOLATING WALL ASSEMBLY HAVING AT LEAST ONE ACOUSTIC SCATTERER

CROSS-REFERENCE TO RELATED APPLICATION

This application claims the benefit of U.S. Provisional Patent Application No. 63/112,948, entitled "SOUND ISOLATING WALL ASSEMBLY HAVING AT LEAST ONE ACOUSTIC SCATTERER," filed Nov. 12, 2020, which is incorporated by reference herein in its entirety.

TECHNICAL FIELD

The present disclosure generally relates to sound isolating wall assemblies and, more particularly, to sound isolating wall assemblies that include at least one acoustic scatterer.

BACKGROUND

The background description provided is to present the context of the disclosure generally. Work of the inventors, to the extent it may be described in this background section, and aspects of the description that may not otherwise qualify as prior art at the time of filing, are neither expressly nor impliedly admitted as prior art against the present technology.

The interiors of buildings, which may be made up of one or more rooms, can experience noise pollution emanating from within the building or outside the building. For example, if a building is located near a street, rooms within the building located may experience unwanted noises, such as noises generated by vehicles, pedestrians, trains, and the like. Additionally, in some cases, unwanted noises are generated within the building itself. For example, a person within one room may be speaking loudly, causing unwanted noise to enter another room.

When constructing a building and/or rooms within a building, prior art technology usually relies on either high reflection materials that reflect sounds or porous materials that may be able to absorb sound. However, both have their drawbacks. For example, the performance of reflection type materials are usually limited by the "mass law," while the porous material does not provide high sound isolation. The "mass-law" states that doubling the mass per unit area increases the sound transmission loss ("STL") by six decibels. Similarly, doubling the frequency increases the STL by six decibels. This effect makes it difficult to isolate low-frequency sound using lightweight materials.

With regards to porous materials, conventional porous sound-absorbing materials are only efficient for high frequency (greater than 1 kHz) noise reduction due to its high impedance nature. The sound transmission through porous materials is high if the material microstructure has a large porosity.

SUMMARY

This section generally summarizes the disclosure and is not a comprehensive disclosure of its full scope or all its features.

In one example, a sound isolating wall assembly includes a plurality of walls defining a space between the plurality of walls. At least one acoustic scatterer is disposed within the space between the plurality of walls. The at least one acoustic scatterer has an opening and at least one channel.

The at least one channel has a channel open end and a channel terminal end, with the channel open end being in fluid communication with the opening.

The at least one acoustic scatterer utilized within the sound isolating wall assembly may take any one of a number of different forms. In one example, the at least one acoustic scatterer is in the form of a half scatterer and is attached to one of the plurality of walls. In another example, the at least one acoustic scatterer is in the form of a degenerative scatterer that is located away from the plurality of walls.

In another example, the sound isolating wall assembly described above may also include a porous material located within the space between the plurality of walls. By utilizing porous materials in addition to the at least one acoustic scatterer, both high-frequency and low-frequency noises may be effectively reduced.

Further areas of applicability and various methods of enhancing the disclosed technology will become apparent from the description provided. The description and specific examples in this summary are intended for illustration only and are not intended to limit the scope of the present disclosure.

BRIEF DESCRIPTION OF THE DRAWINGS

The present teachings will become more fully understood from the detailed description and the accompanying drawings, wherein:

FIGS. 6A and 6B illustrate detailed views of different examples of degenerative scatterers utilized in the sound isolating wall assembly of FIG. 5.

The figures set forth herein are intended to exemplify the general characteristics of the devices among those of the present technology, for the description of certain aspects. These figures may not precisely reflect the characteristics of any given aspect and are not necessarily intended to define or limit specific embodiments within the scope of this technology. Further, certain aspects may incorporate features from a combination of figures.

DETAILED DESCRIPTION

The present teachings provide for a sound isolating wall assembly that may be utilized in a variety of different applications, such as a wall for a room or a duct that guides air from one location to another. Regardless of the application, the acoustic wall assembly is able to reduce unwanted noises.

The sound isolating wall assembly may be made up of a plurality of walls, such as four walls that define the space between the walls. Located within the space between the walls is at least one acoustic scatterer. In one example, the acoustic scatterer may be a half scatterer that is attached to one of the plurality of walls. In another example, the acoustic scatterer may be in the form of a degenerative scatterer that is located within the space between but generally does not come into physical contact with the plurality of walls.

As will be explained later in this specification, the acoustic scatterers that are located within the space between can generally absorb low-frequency noises that entered the wall. In addition, the sound isolating wall assembly can essentially break the "mass-law" near the resonant frequency of the acoustic scatterer. At the resonant frequency, the effective mass density of the sound isolating wall assembly becomes negative so that the sound speed, as well as the wavenumber in the material, becomes imaginary. The imaginary wavenumber indicates that the wave is exponentially decaying in the material. Also, the impedance of the material is matched to air at the same frequency so that there is no reflection. As a result, all the energy may be absorbed, and hence the STL is higher than the mass-law within a certain frequency band.

As stated before, the acoustic scatterers located within the sound isolating wall assembly are proficient in absorbing low-frequency sounds. In one example of the sound isolating wall assembly, porous materials may be deposited within the space defined by the plurality walls. As such, by utilizing both acoustic scatterers and porous materials within the space between, the sound isolating wall assembly can absorb sound that entered the wall across of range of frequencies—both high frequencies and low frequencies.

Figure 1A:
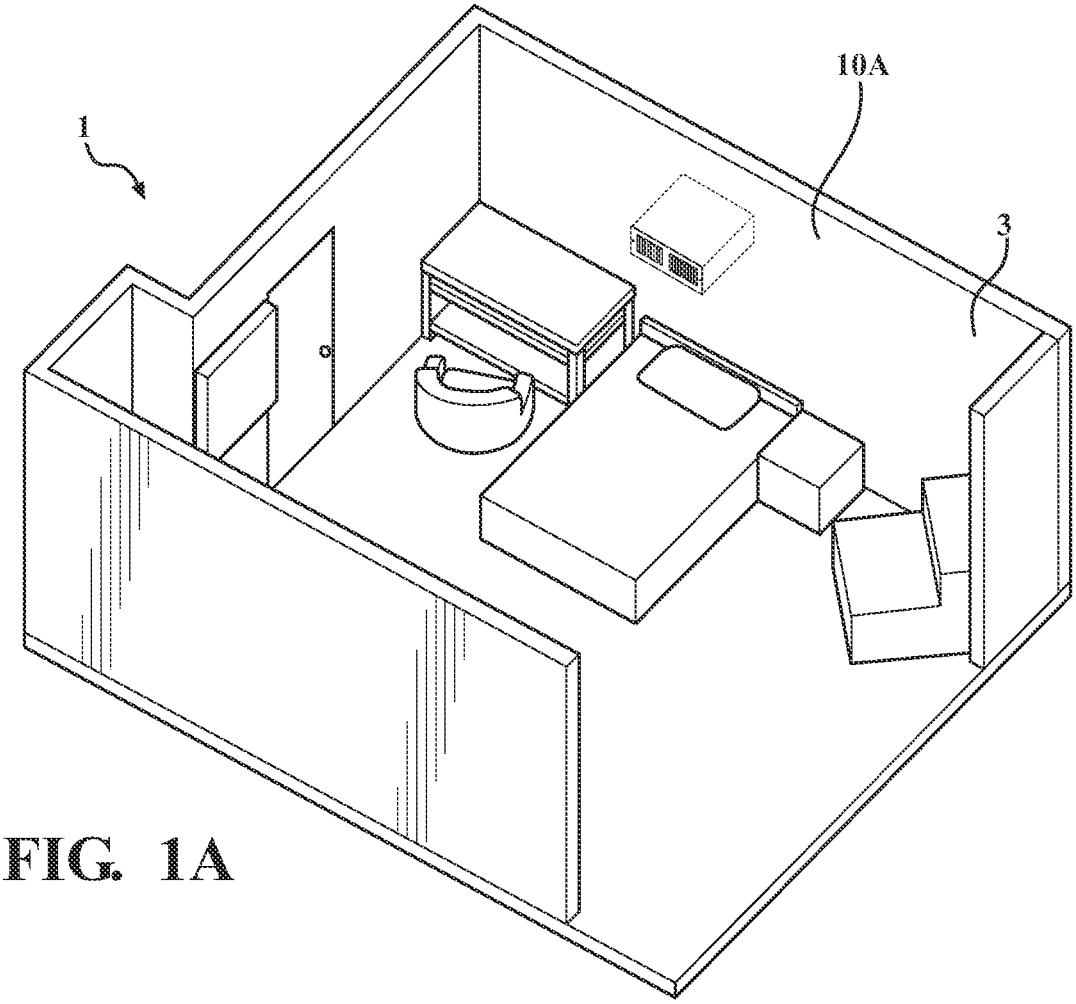
FIGS. 1A and 1B illustrate two different applications of sound isolating wall assemblies.

Referring to FIG. 1A, illustrated is a room 1. In this example, the room 1 is in the form of a bedroom but can be any type of room located within a building. As such, the room 1 could be a warehouse space, manufacturing space, office, kitchen, living room, dining room, bathroom, and the like. In this example, the room 1 includes a plurality of walls. At least one of the walls 3 may be constructed using a sound isolating wall assembly 10A.

The sound isolating wall assembly 10A can be used in any one of a number of different applications. In this example, the sound isolating wall assembly 10A is shown in the form of a wall, which may be utilized to define rooms within a building or may be utilized in one or more exterior walls of a building. As such, as will be described later in this specification, the sound isolating wall assembly 10A reduces unwanted noises entering into or exiting from the room 1.

Other applications may also be possible. For example, the movement of air via a duct may cause unwanted low-frequency noises. As such, referring to FIG. 1B, this example illustrates the use of a sound isolating wall assembly 10B for use as an air duct 4 that moves air from one location to another and may direct air towards a vent 5, which can then distribute air into a room or other location. Again, it should be understood that the examples shown in FIGS. 1A and 1B are just one of many applications of the sound isolating wall assemblies described in this specification.

Figure 1B:
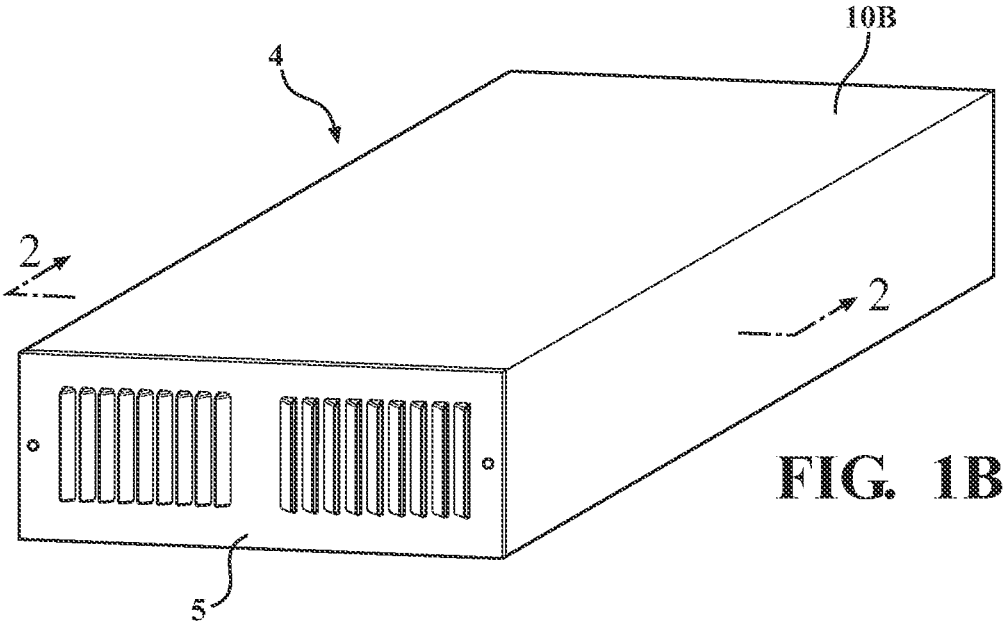
Figure 2:
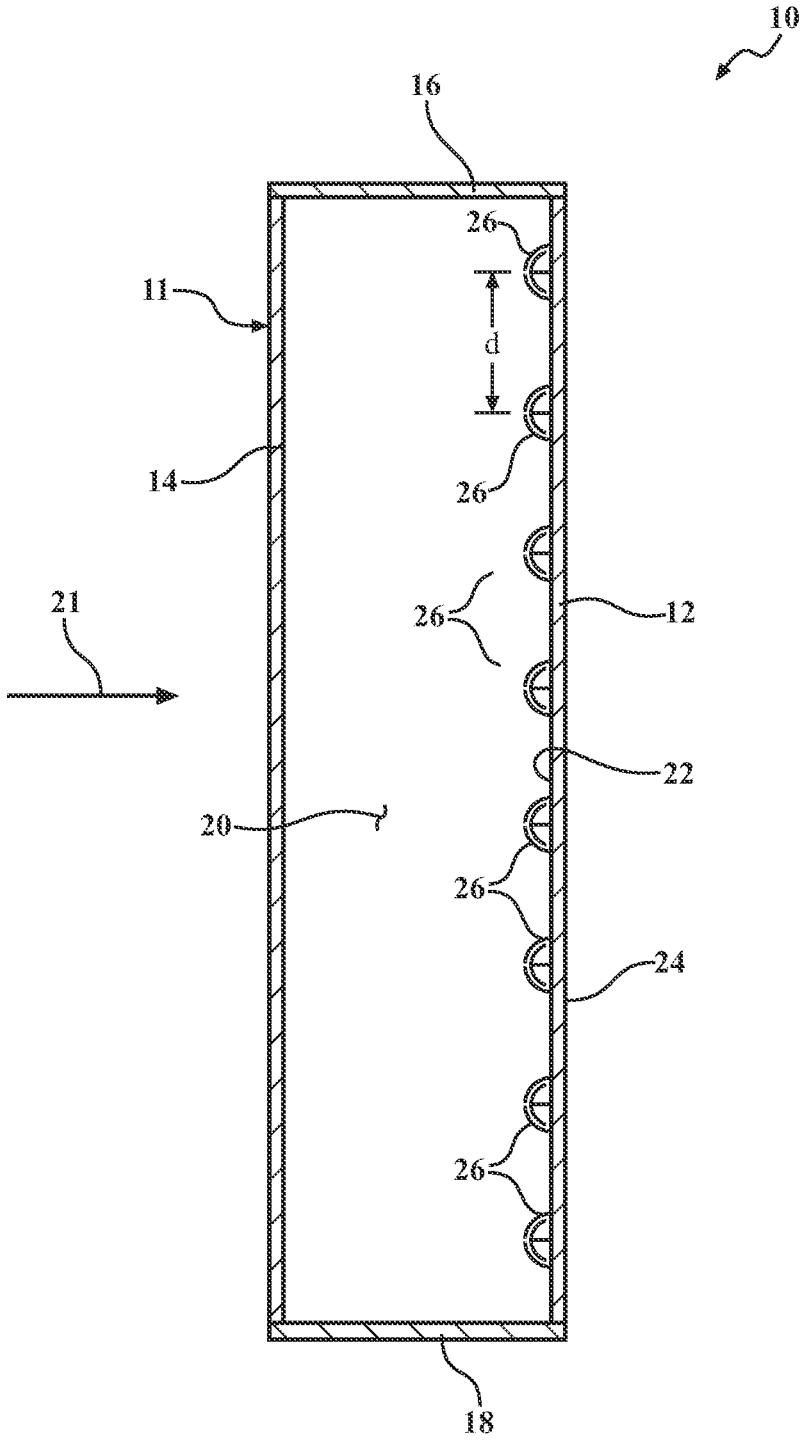
FIG. 2 illustrates one example of a sound isolating wall assembly utilizing half scatterers.

Referring to FIG. 2, one example of the sound isolating wall assembly 10, generally taken along lines 2-2 of FIGS. 1A and 1B is shown. Here, the sound isolating wall assembly 10 generally includes a plurality of walls 11. The plurality of walls 11 generally define a space 20 located between the plurality of walls 11.

The plurality of walls 11 may include two or more walls. In this example, the plurality of walls 11 includes a first wall 12. The first wall 12 may have a first surface 22 and a second surface 24 located on opposing sides of the first wall 12. The first surface 22 may generally face towards the space 20 defined by the plurality of walls 11. The first wall 12 may be made of an acoustically hard material, such as plastic, metal, glass, concrete, and the like.

The plurality of walls 11 may also include a second wall 14 that generally opposes the first wall 12. In this example, the second wall 14 does not necessarily need to be made of an acoustically hard material. However, there is no restriction on having the second wall 14 also made of an acoustically hard material similar to the material utilized to make the first wall 12.

The plurality of walls 11 may also include a third wall 16 and a fourth wall 18. The third wall 16 and the fourth wall 18 may be located at opposing ends of the first wall 12 and the second wall 14. In one example, the third wall 16 and the fourth wall 18 are connected to both the first wall 12 and the second wall 14. By connecting the third wall 16 and the fourth wall 18 to the first wall 12 and the second wall 14, the space 20 between the plurality of walls 11 is defined. In one example, the space 20 may be in the form of a cuboid shape. However, it should be understood that the space 20 may be in the form of anyone of a number of different shapes.

The walls 12-18 making up the plurality of walls 11 may be made of similar material and may be connected to each other via any one of a number of different means. For example, the walls 12-18 may be connected to each other using any one of a number of mechanical devices, such as nails, screws, bolts and the like or may be adhered to each other. Further, the walls 12-18 may be made of a single unitary structure.

Located within the space 20 defined by the plurality walls 11 are a plurality of half scatterers 26. The plurality of half scatterers 26 may be attached to the first wall 12. Generally, the plurality of half scatterers 26 should be attached to a wall that is made of an acoustically hard material, such as the first wall 12.

The plurality of half scatterers 26 may form an array. The half scatterers 26 are separated from each other by a distance of d. It should be understood that the half scatterers 26 and the first wall 12 may be a unitary structure or may utilize one of several different methodologies to connect the half scatterers 26 to the first wall 12. In one example, the half scatterers 26 may be adhered to the first wall 12 using an adhesive, but other types of methodologies to connect the half scatterers 26 to the first wall 12 may be utilized, such as mechanical devices like screws, bolts, clips, and the like. Alternatively, as stated before, the half scatterers 26 and the first wall 12 may be formed as a unitary structure. The half scatterers 26 may be made of an acoustically hard material, such as concrete, metal, glass, wood, plastic, combinations thereof, and the like. In one example, the half scatterers 26 may be made of the same material as the first wall 12.

Each of the half scatterers 26 has a resonant frequency. The resonant frequency of each of the half scatterers 26 may be the same resonant frequency or may be different resonant frequencies. Sound absorbed by the sound isolating wall assembly 10, as will be explained later, substantially matches the resonant frequency of the half scatterers 26. By utilizing acoustic scatterers having different resonant frequencies, a wider range of sounds with different frequencies can be absorbed by the sound isolating wall assembly 10.

In this example, a total of eight half scatterers 26 are attached to the first wall 12. However, it should be understood that any number of half scatterers 26 may be utilized. In some examples, only one half scatterer 26 may be utilized, while, in other examples, numerous half scatterers 26 may be utilized.

A projected sound 21, which may also be referred to as a noise, may originate from any one of several different sources or combinations thereof. For example, the source of the projected sound 21 may originate from a speaker, vehicle, aircraft, watercraft, train, and the like. Again, it should be understood that the sound isolating wall assembly 10 can be used in any situation where it is desirable to eliminate or reduce sounds of certain frequencies. The incidence angle of sound waves, such as the projected sound 21, absorbed by the sound isolating wall assembly 10 varies based on the distance d between the plurality of half scatterers 26.

The projected sound 21 is at least partially reflected by the first wall 12 without a phase change. The half scatterers 26 behave like a monopole source at a certain distance from the first wall 12, and its mirror image radiates a monopole moment as well. The two monopoles form a new plane wave having a direct reflection from the first wall 12 with a 180° phase difference. As such, the wave reflected by the first wall 12 is essentially canceled out by the new plane wave, thus absorbing the projected sound 21.

The absorption performance of the sound isolating wall assembly 10 may be incident angle dependent. The sound isolating wall assembly 10 and half scatterers 26 disclosed in this disclosure operate over a relatively wide range of incidence. Total absorption can still be achieved for 30-degree and 45-degree incidence. However, high order diffraction modes will start to propagate with the increase of the incident angle. This phenomenon will change the absorption performance. When the high order diffraction modes exist at the scatterer resonant frequency, and the incident angle is sufficiently large, then the sound isolating wall assembly 10 may not achieve total absorption. The disclosed design is tunable so that the spacing between half scatterers 26 can be reduced, and hence increase the working angle.

Another benefit of the acoustic scatterer design disclosed in this disclosure is that the half scatterers 26 are separated from each other, so there may be ample space to combine one design with another to cover more frequencies. For example, half scatterers 26 with different resonant frequencies can be utilized to absorb and improve STL across a wider range of frequencies. The resonant frequency is tuned by adjusting the size of the half scatterer 26 and the channel and/or cavity, as well as the width and length of the air channel. Different acoustic scatterer designs may then be combined to achieve broadband performance.

The space between the half scatterers 26 of the sound isolating wall assembly 10 can be tuned. The benefit of tunable spacing is that one can choose between sparsity and the working angle of the material. By reducing the space, the performance of the sound isolating wall assembly 10 will be less sensitive to the incident angle of the wave.

Figure 3A:
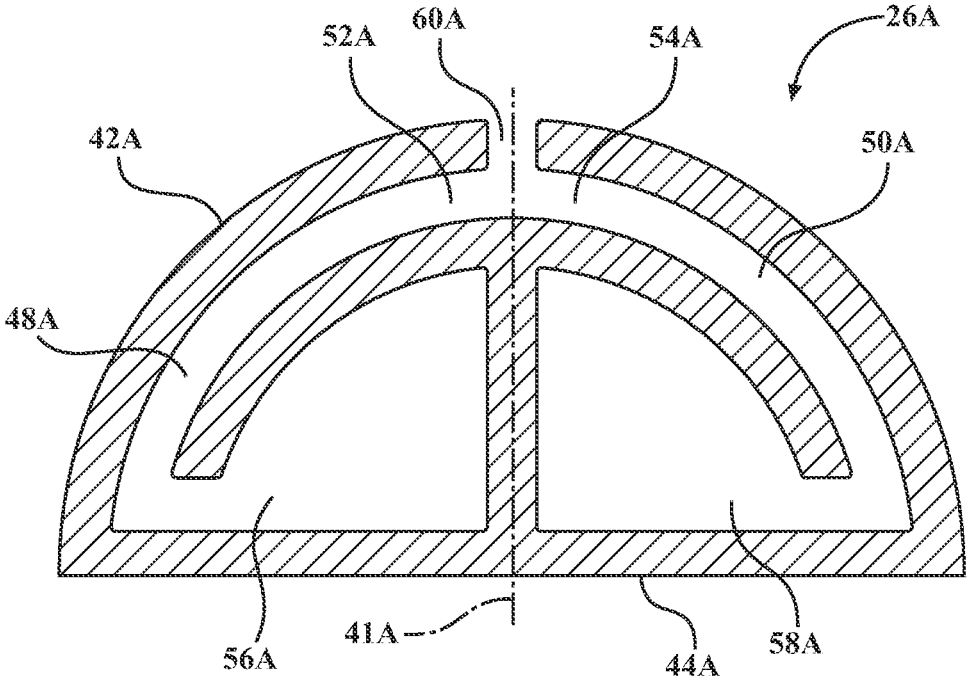
FIGS. 3A and 3B illustrate detailed views of different examples of half scatterers utilized in the sound isolating wall assembly of FIG. 2.

The half scatterers 26 of FIG. 2 can take any one of several different forms. For example, FIG. 3A illustrates a cross-sectional view of one example of a half scatterer 26A. This is just but one example of the design of the half scatterer 26A. Here, the half scatterer 26A is generally in the shape of a half-cylinder. The half-cylinder shape of the half scatterer 26A includes a substantially semicircular portion 42A and a substantially flat portion 44A. The substantially flat portion 44A may be attached to the first surface 22 of the first wall 12 shown in FIG. 2. Additionally, as stated before, the half scatterer 26A and the first wall 12 shown in FIG. 2 may be a unitary structure or may be connected to each other using the previously mentioned methodologies. It should be understood that the semicircular portion 42A may take any one of several different shapes. These shapes may be non-planar, but any suitable shape may be utilized.

The half scatterer 26A may be made of any one of several different materials. Like before, the half scatterer 26A may be made of an acoustically hard material, such as concrete, metal, glass, wood, plastic, combinations thereof, and the like. In one example, the half scatterer 26A may be made of the same material as the first wall 12.

The overall shape of the half scatterer 26A may be substantially uniform along the length of the half scatterer 26A. In this example, the half scatterer 26A may include a first channel 48A that has an open end 52A and a terminal end 56A. The half scatterer 26A may also include a second channel 50A that has an open end 54A and a terminal end 58A. The open ends 52A and 54A may be in fluid communication with an opening 60A formed on the semicircular portion 42A of the half scatterer 26A. The opening 60A may be directly adjacent to the open end 52A and/or the open end 54A. The opening 60A may be adjacent to a line of symmetry 41A of the half scatterer 26A. As to the terminal ends 56A and 58A, these ends are separated from each other and are not in fluid communication with each other. The terminal ends 56A and 58A may terminate in any one of several different shapes. Moreover, the terminal ends 56A and 58A may terminate in the form of a chamber or may terminate in the form of a closed off channel.

The channels 48A and 50A may have a circumferential type shape that generally follows the circumference defined by the semicircular portion 42A. The opening 60A may have a width that is substantially similar to the width of the channels 48A and 50A. However, the widths of the channels may vary considerably.

The half scatterer 26A may have a line of symmetry 41A. In this example, the shape of the first channel 48A is essentially a mirror image of the second channel 50A. In addition, the volumes of the channels 48A and 50A may be substantially equal. "Substantially equal" in this disclosure should be understood to indicate approximately a 10% difference in the overall volume or shape of the channels 48A and 50A. The resonant frequency of the channels 48A and 50A may be the same.

It should be understood that the number of channels and the shape of the channels can vary from application to application. In this example described, the half scatterer 26A has two channels—channels 48A and 50A. However, more or fewer channels may be utilized. In the case of multiple channels, the additional channels may have a similar shape to each other with the same channel cross-section area and length and the same cavity volume, similar to the channels 48A and 50A shown.

Figure 3B:
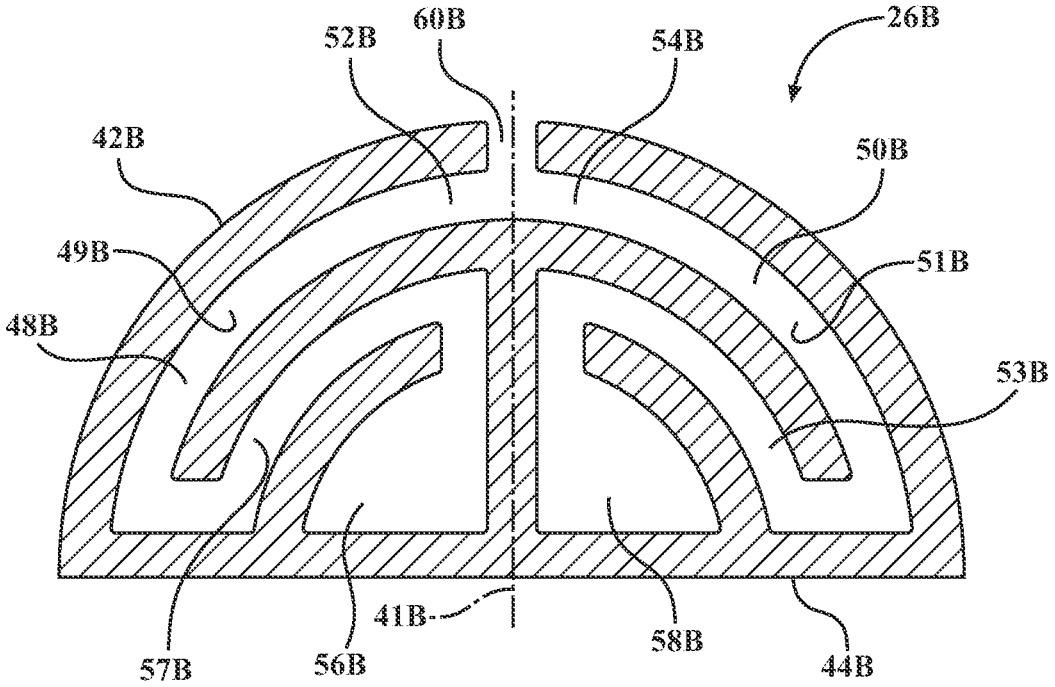

As stated before, the half scatterers 26 of FIG. 2 can take any one of several different shapes. FIG. 3B illustrates another example of a half scatterer 26B. Here, the half scatterer 26B includes a first channel 48B and a second channel 50B. Both the first and second channels 28B and 30B have open ends 52B and 54B, respectively. Also, the first and second channels 48B and 50B have terminal ends 56B and 58B, respectively. The open ends 52B and 54B of the channels 48B and 50B may be in fluid communication with the opening 60B generally formed on the outer circumference 42B of the half scatterer 26B. The opening 60B may be adjacent to a line of symmetry 41B of the half scatterer 26B. The terminal ends 56B and 58B may be in the form of a chamber or may be in the form of a closed off channel.

Like before, the flat side 44B may be attached to the first surface 22 of the first wall 12 by any one of several different methodologies mention. Additionally, like before, the half scatterer 26B and the first wall 12 may be a unitary structure.

In this example, the first channel 48B is essentially a zigzag channel. Moreover, the first channel 48B includes a first channel part 49B and a second channel part 57B that generally are parallel to one another and may have similar arcs. The second channel 50B is similar in that it has a first channel part 51B and a second channel part 53B that generally run parallel to each other and may have similar arcs. However, anyone of several different designs can be utilized.

The half scatterer 26B may also have a line of symmetry 41B. As such, the first channel 48B may essentially be a mirror image of the second channel 50B. Likewise, the volume of the first channel 48B may be substantially equal to the volume of the second channel 50B.

Figure 4:
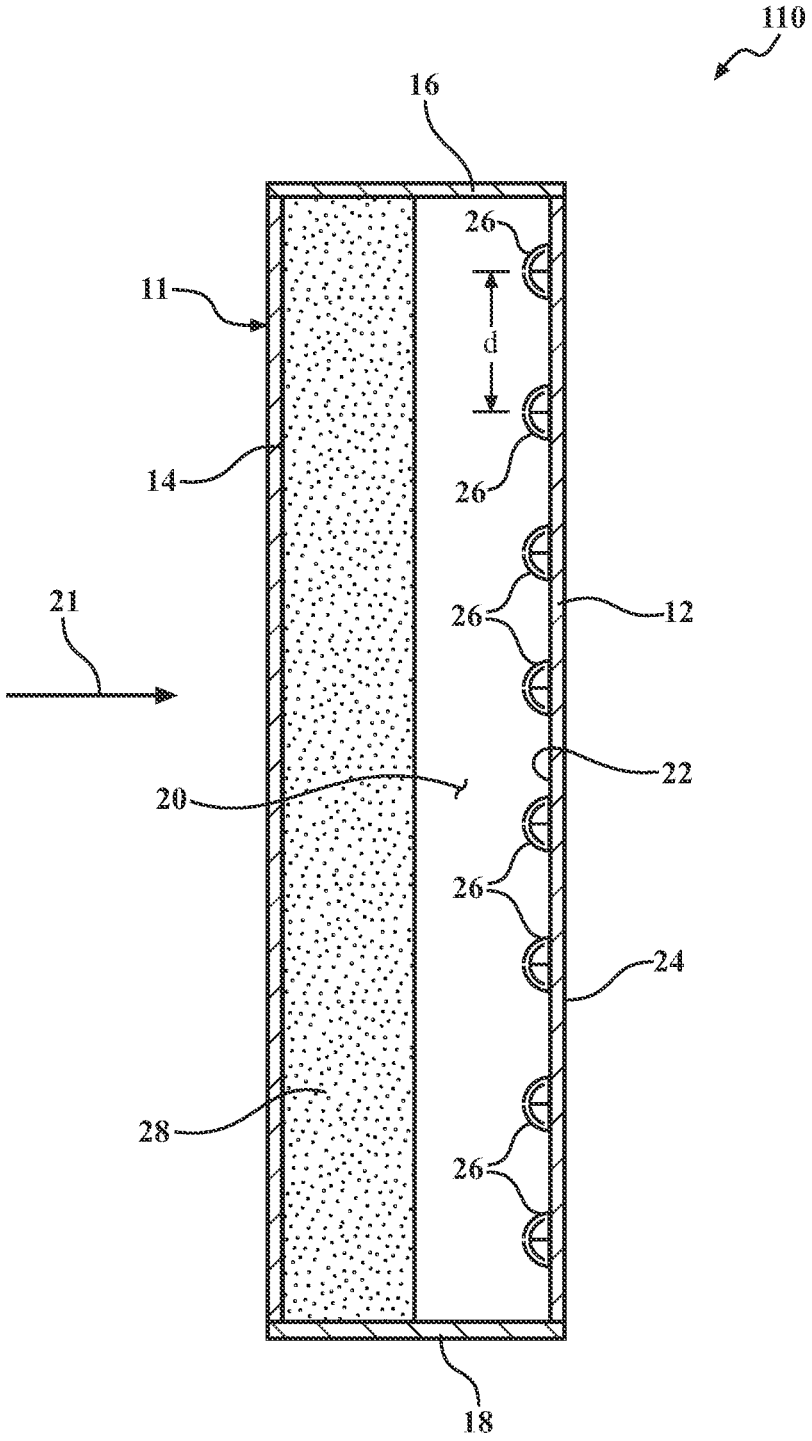
FIG. 4 illustrates another example of a sound isolating wall assembly utilizing half scatterers that also utilizes a porous material.

Referring to FIG. 4, another example of a sound isolating wall assembly 110 is shown. The sound isolating wall assembly 110 of FIG. 4 has some similarities to the sound isolating wall assembly 10 of FIG. 3A. As such, like reference numbers have been utilized to refer to like elements and previous descriptions of these elements are equally applicable here.

Like before, the sound isolating wall assembly 110 includes a plurality of walls 11. In this example, the plurality of walls 11 include a first wall 12, a second wall 14, a third wall 16, and a fourth wall 18. Additionally, like before, a plurality of half scatterers 26 are attached to a first surface 22 of the first wall 12 in generally face the space 20 defined by the plurality of walls 11.

As stated before, the half scatterers 26 are generally very good at absorbing lower frequency sounds. Porous materials, such as foams, are generally more adept at absorbing sounds at higher frequencies. As such, the sound isolating wall assembly 110 also includes a porous material 28 located within the space 20 defined by the plurality of walls 11. The porous material 28 may include channels, cracks, and/or cavities, which allow the sound waves to enter the porous material 28. Sound energy is dissipated by thermal loss caused by the friction of air molecules within the porous material 28. The porous material 28 may occupy one a portion of the space 20, as shown, or all the space 20.

The porous material 28 may be made of any type, or combination thereof, of sound absorbing material, such as foams, rock wool, glass wool, recycled foam, and/or reticulated fibrous materials like aluminum rigid frame porous material, ceramics, and polymers. As such, the sound isolating wall assembly 110, by utilizing both the half scatterers 26 and the porous material 28, one can reduce unwanted noises across a broad range in frequencies.

Figure 5:
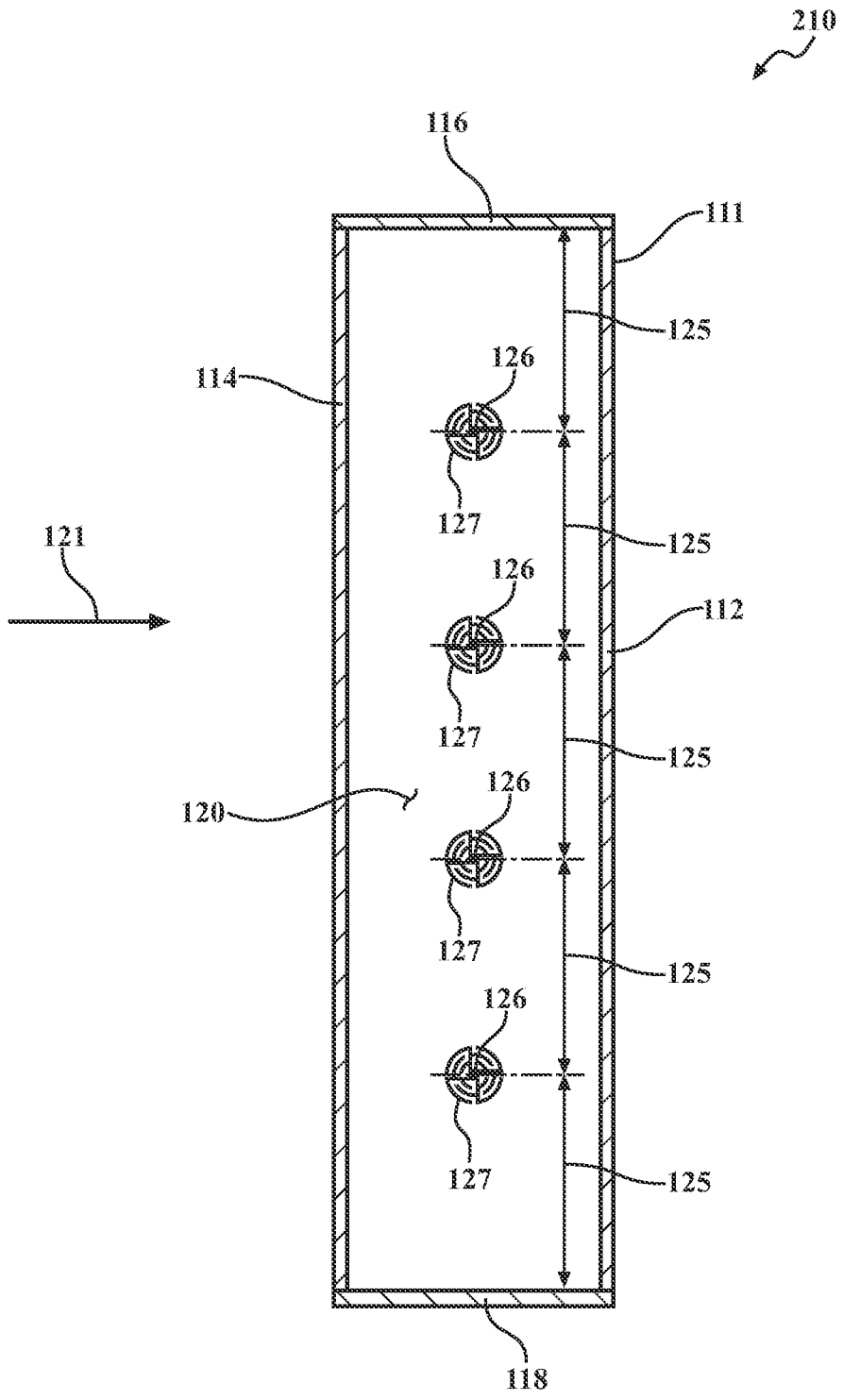
FIG. 5 illustrates one example of a sound isolating wall assembly utilizing degenerative scatterers.

Referring to FIG. 5, another example of a sound isolating wall assembly 210 is shown. Like the sound isolating wall assembly 10 of FIG. 3A, the sound isolating wall assembly 210 includes a plurality of walls 111. The plurality walls 111 include a first wall 112, a second wall 114, a third wall 116, and a fourth wall 118. Like before, the first wall 112 may face the second wall 114, while the third wall 116 may face the fourth wall 118. The plurality of walls 111 define a space 120 between. In this example, the third wall 116 and the fourth wall 118 may be made of is an acoustically hard material, while the first wall 112 and the second wall 114 may be made of an acoustically softer material.

The plurality of walls 111 may be connected to each other using a variety of different methodologies. In this example, the third wall 116 and the fourth wall 118 are each separately connected to the first wall 112 and the second wall 114. The connection of these walls may be achieved using any one of a number different connection methodologies, such as the use of adhesives, nails, screws, bolts, combinations thereof, and the like. Furthermore, the plurality walls 11 may be made of a unitary structure.

Located within the space 20 are a plurality of degenerative scatterers 126 that are separated from each other by a distance 125. It is noted that the degenerative scatterers 126 that are located nearest the third wall 116 and the fourth wall 118 are also separated from the third wall 116 and the fourth wall 118 by a similar distance 125. In this example, for degenerative scatterers 126 are shown. However, it should be understood that any number of degenerative scatterers 126 could be utilized.

The distances 125 between each of the degenerative scatterers 126 and/or the degenerative scatterers 126 at the end of the row and the third wall 116 or fourth wall 118 are substantially equal. Regarding "substantially equal", this means that the distances 125 may vary by as much as 10%. The total number of degenerative scatterers 126 for the array to optimally absorb sound inside the wall is generally based on a distance between the third wall 116 and the fourth wall 118. The total minimum number (N) of acoustic scatterers required for an application can be expressed as follows:

$$N=D/(c/f),$$

wherein D is a distance between the third wall 116 and the fourth wall 118, c is the speed of sound in air, and f is the resonant frequency of the monopole response and the dipole response.

The rotational direction of the degenerative scatterers 126 with respect to a sound 121 may not impact the ability of the degenerative scatterers 126 to absorb sound at a resonant frequency.

The degenerative scatterers 126 may have an acoustic monopole response and an acoustic dipole response. An acoustic monopole radiates sound waves towards all direction. The radiation pattern of monopole generally has no angle dependence for both magnitude and phase of the sound pressure. The radiation of acoustic dipole has an angle dependence $e^{i\theta}$, where $\theta$ is the polar angle in 2D. The pressure fields have the same magnitude and the opposite phase at the same distance along the two opposite radiation directions. The monopole response is equivalent to the sound radiated from a pulsating cylinder whose radius expands and contracts sinusoidally. The dipole response is equivalent to the sound radiated from two pulsating cylinders separated from each other with a small distance; the two pulsating cylinders radiate sound with the same strength but opposite phase.

The acoustic dipole response and the acoustic monopole response of the degenerative scatterers 126 may have substantially similar resonant frequencies. Like before, the term "substantially similar" regarding resonant frequencies should be understood to mean that the resonant frequencies may differ by approximately 10% or less. The degenerative scatterers 126 generally have housings 127 that defines the overall shape of the degenerative scatterers 126. Generally, the housings 127 may be symmetrical across the width of the housings 127. However, the housings 127 may take anyone of a number of different shapes.

Referring to FIG. 6A-6B, a cross-section, of different examples of degenerative scatterers 126A and 126B are shown. It should be understood that the different designs of the degenerative scatterers 126A and 126B shown in FIGS. 6A and 6B are merely examples. The degenerative scatterers 126 could take any one of a number of different designs, not just those shown and described in this disclosure. Each of the degenerative scatterers 126A and 126B may have housings 127A and 127B that are generally symmetrical in shape across the width of the housings 127A and 127B. Each housing 127A and 127B generally define a perimeter 128A-128D. The generally symmetrical in shape across the width of the housings 127A and 127B may be substantially circular in shape as shown. However, should be understood that any one of a number of different shapes could be utilized.

The degenerative scatterers 126A and 126B may have a plurality of channels. For example, the degenerative scatterer 126A has four channels 130A, 132A, 134A, and 136A. As such, the degenerative scatterer 126A of FIG. 6A is a four-channel degenerative scatterer. The degenerative scatterer 126B of FIG. 6B has six channels 130B, 132B, 134B, 136B, 138B, and 139B. As such, the degenerative scatterer 126B of FIG. 6B is a six-channel degenerative scatterer. It should be understood that any one of a number of channels may be utilized in the degenerative scatterers 126A and/or 126B. However, as will be explained later, three or more channels allow for the degenerative scatterers 126A, and/or 126B being equally effective regardless of the rotational positioning of the degenerative scatterer 126A and/or 126B.

The degenerative scatterer 126A, as stated previously, is a four-channel degenerative scatterer and therefore has four channels 130A, 132A, 134A, and 136A. Each of the four channels 130A, 132A, 134A, and 136A have an open and 140A, 142A, 144A, and 146A, respectively, located adjacent to the outer perimeter 128A. In addition, each of the four channels 130A, 132A, 134A, and 136A have terminal ends 150A, 152A, 154A, and 156A, respectively. The terminal ends 150A, 142A, 154A, and 156A may be located near a center 129A of the degenerative scatterer 126A. The terminal ends 150A, 152A, 154A, and 156A may be separate from each other and may not be in fluid communication with each other.

The volumes of the channels 130A, 132A, 134A, and 136A may be substantially equal to each other. Additionally, the overall shape of the channels 130A, 132A, 134A, and 136A across the width of the degenerative scatterer 126A may be substantially similar in shape and/or design.

With regards to the design of the channels 130A, 132A, 134A, and 136A, the channels may have a general zigzag type form. For example, with regard to the channel 132A, the channel may have a zigzag, wherein one portion 133A of the channel 132A runs partially or substantially parallel to another portion 135A of the channel 132A. However, it should be understood that the design of the channel may vary greatly and may not necessarily be a zigzag type design. Additionally, this exact type design may be such that one portion of the channel does not run substantially parallel to another portion of the channel, as shown in the example of FIG. 6A.

Turning our attention to the degenerative scatterer 126B, as stated previously, the degenerative scatterer 126B is a six-channel degenerative scatterer and therefore includes channels 130B, 132B, 134B, 136B, 138B, and 139B. Each of the six channels 130B, 132B, 134B, 136B, 138B, and 139B have an open and 140B, 142B, 144B, 146B, 148B, and 149B, respectively, located adjacent to the outer perimeter 128B. In addition, each of the six channels 130B, 132B, 134B, 136B, 138B, and 139B have terminal ends 150B, 152B, 154B, 156B, 158B, and 159B, respectively. The terminal ends 150B, 152B, 154B, 156B, 158B, and 159B may be located near a center 129B of the degenerative scatterer 126B. The terminal ends 150B, 152B, 154B, 156B, 158B, and 159B may be separate from each other and may not be in fluid communication with each other.

The volumes of the channels 130B, 132B, 134B, 136B, 138B, and 139B may be substantially equal to each other. Additionally, the overall shape of the channels 130B, 132B, 134B, 136B, 138B, and 139B across the width of the degenerative scatterer 126B may be substantially similar in shape and/or design.

With regards to the design of the channels 130B, 132B, 134B, 136B, 138B, and 139B, the channels may have a general zigzag type form. For example, with regard to the channel 130B, the channel may have a zigzag, wherein one portion 133B of the channel 130B runs partially or substantially parallel to another portion 135B of the channel 130B. However, it should be understood that the design of the channel may vary greatly and may not necessarily be a zigzag type design. Additionally, this exact type design may be such that one portion of the channel does not run substantially parallel to another portion of the channel, as shown in the example of FIG. 6B.

The degenerative scatterers 126A and/or 126B may be made using any one of several different materials. For example, the degenerative scatterers 126A and/or 126B may be made from an acoustically hard material, such as plastic, silicon, glass, and/or metals.

Figure 7:
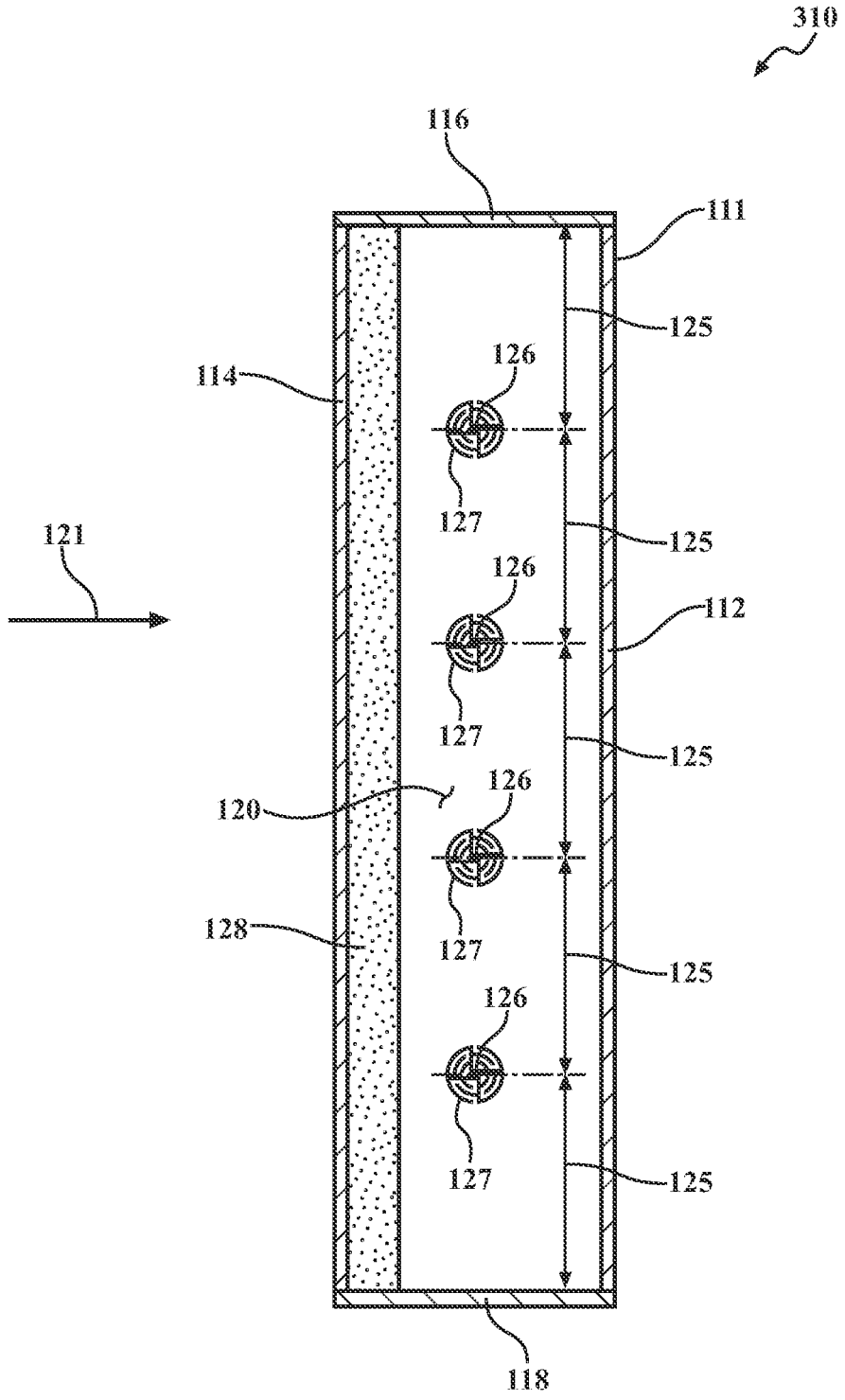
FIG. 7 illustrates another example of a sound isolating wall assembly utilizing degenerative scatterers that also utilizes a porous material.

Referring to FIG. 7, another example of a sound isolating wall assembly 310 is shown. The sound isolating wall assembly 310 of FIG. 7 has some similarities to the sound isolating wall assembly 210 of FIG. 5. As such, like reference numbers have been utilized to refer to like elements and previous descriptions of these elements are equally applicable here.

Like before, the sound isolating wall assembly 310 includes a plurality of walls 111. In this example, the plurality of walls 111 include a first wall 112, a second wall 114, a third wall 116, and a fourth wall 118. As stated before, the degenerative scatterers 126 are generally very good at absorbing lower frequency sounds. Porous materials, such as foams, are generally more adept at absorbing sounds at higher frequencies. As such, the sound isolating wall assembly 310 also includes a porous material 128 located within the space 120 defined by the plurality of walls 111. The porous material 128 may include channels, cracks, and/or cavities which allow the sound waves to enter the porous material 128. Sound energy is dissipated by thermal loss caused by the friction of air molecules within the porous material 128. The porous material 128 may occupy one a portion of the space 120 or all the space 120.

The porous material 128 may be made of any type, or combination thereof, of sound absorbing material, such as foams, rock wool, glass wool, recycled foam, and/or reticulated fibrous materials like aluminum rigid frame porous material, ceramics, and polymers. As such, the sound isolating wall assembly 110, by utilizing both the degenerative scatterers 126 and the porous material 128, one can reduce unwanted noises across a broad range in frequencies.

The preceding description is merely illustrative in nature and is in no way intended to limit the disclosure, its application, or uses. As used herein, the phrase at least one of A, B, and C should be construed to mean a logical (A or B or C), using a non-exclusive logical "or." It should be understood that the various steps within a method may be executed in different order without altering the principles of the present disclosure. Disclosure of ranges includes disclosure of all ranges and subdivided ranges within the entire range.

The headings (such as "Background" and "Summary") and sub-headings used herein are intended only for general organization of topics within the present disclosure and are not intended to limit the disclosure of the technology or any aspect thereof. The recitation of multiple embodiments having stated features is not intended to exclude other embodiments having additional features, or other embodiments incorporating different combinations of the stated features.

As used herein, the terms "comprise" and "include" and their variants are intended to be non-limiting, such that recitation of items in succession or a list is not to the exclusion of other like items that may also be useful in the devices and methods of this technology. Similarly, the terms "can" and "may" and their variants are intended to be non-limiting, such that recitation that an embodiment can or may comprise certain elements or features does not exclude other embodiments of the present technology that do not contain those elements or features.

The broad teachings of the present disclosure can be implemented in a variety of forms. Therefore, while this disclosure includes particular examples, the true scope of the disclosure should not be so limited since other modifications will become apparent to the skilled practitioner upon a study of the specification and the following claims. Reference herein to one aspect, or various aspects means that a particular feature, structure, or characteristic described in connection with an embodiment or particular system is included in at least one embodiment or aspect. The appearances of the phrase "in one aspect" (or variations thereof) are not necessarily referring to the same aspect or embodiment. It should be also understood that the various method steps discussed herein do not have to be carried out in the same order as depicted, and not each method step is required in each aspect or embodiment.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations should not be regarded as a departure from the disclosure, and all such modifications are intended to be included within the scope of the disclosure.

What is claimed is:

1. A sound isolating wall assembly comprising:

a plurality of walls, the plurality of walls defining a space between the plurality of walls;

at least one degenerative scatterer located within the space defining the plurality of walls;

the at least one degenerative scatterer having an opening and a plurality of channels, the plurality of channels each have a channel open end and a channel terminal end, the channel terminal ends being separate from each other;

wherein the plurality of channels extend parallelly along the length of the at least one degenerative scatterer; and wherein the at least one degenerative scatterer has an acoustic monopole response and an acoustic dipole response, wherein the acoustic dipole response and the acoustic monopole response of the at least one degenerative scatterer have a resonant frequency that is substantially similar.

2. The sound isolating wall assembly of claim 1, further comprising a porous material disposed within the space between the plurality of walls.

3. The sound isolating wall assembly of claim 1, wherein the at least one degenerative scatterer is coupled to one of the plurality of walls.

4. The sound isolating wall assembly of claim 3, wherein the at least one degenerative scatterer has a flat side, the flat side being coupled to one of the plurality of walls.

5. The sound isolating wall assembly of claim 4, wherein the at least one degenerative scatterer has a non-planar side, the non-planar side having the opening, the non-planar side substantially facing toward the space between the plurality of walls.

6. The sound isolating wall assembly of claim 5, wherein the at least one degenerative scatterer has a half-cylinder shape, the half-cylinder shape defining the non-planar side and the flat side.

7. The sound isolating wall assembly of claim 1, wherein the at least one degenerative scatterer comprises a plurality of degenerative scatters.

8. The sound isolating wall assembly of claim 7, wherein the plurality of degenerative scatters includes a first degenerative scatterer having a first resonant frequency and a second degenerative scatterer having a second resonant frequency.

9. The sound isolating wall assembly of claim 1, wherein the sound isolating wall assembly is configured to absorb sound waves at a certain frequency generated by a source of a noise, wherein the certain frequency is substantially similar to a resonant frequency of the at least one degenerative scatterer.

10. The sound isolating wall assembly of claim 1, wherein:

the plurality of channels includes a first channel and a second channel;

the first channel has a first channel open end and a first channel terminal end, the first channel open end being in fluid communication with the opening;

the second channel has a second channel open end and a second channel terminal end, the second channel open end being in fluid communication with the opening; and wherein the first channel terminal end and the second channel terminal end are separate from one another.

11. The sound isolating wall assembly of claim 1, wherein the plurality of channels includes at least three channels.

12. The sound isolating wall assembly of claim 1, wherein the plurality of channels includes at least four channels.

13. The sound isolating wall assembly of claim 1, wherein each channel of the plurality of channels have a substantially similar volume.

14. The sound isolating wall assembly of claim 1, wherein a cross section along a width of the at least one degenerative scatterer defines a symmetrical shape having at least one line of symmetry.

15. The sound isolating wall assembly of claim 1, further comprising:

a plurality degenerative scatterers forming an array of degenerate scatters wherein the plurality of walls includes a first wall and a second wall, the first wall substantially facing the second wall;

the array of degenerate scatters located between the first wall and the second wall, wherein the array of degenerate scatters includes a number (N) of degenerative scatterers;

wherein a number (N) of the plurality degenerative scatterers is:

$N=D/(c/f)$; and wherein D is a distance between the first wall and the second wall, c is the speed of sound in air, and f is the resonant frequency of the acoustic monopole response and the acoustic dipole response.

16. The sound isolating wall assembly of claim 1, further comprising:

wherein the plurality of walls includes a first wall, a second wall, a third wall and a fourth wall;

the first wall substantially faces the second wall, the first wall and the second wall being connected to the third wall and the fourth wall; and the third wall substantially faces the fourth wall.

17. The sound isolating wall assembly of claim 1, wherein the space between the plurality of walls is substantially cuboid in shape.

18. The sound isolating wall assembly of claim 1, wherein the plurality of walls form a duct structure for guiding a movement of air.

19. The sound isolating wall assembly of claim 1, wherein the sound isolating wall assembly is configured to be used as a wall for a building structure.

* * * * *